United States Patent [19]

Ichitsubo

[11] Patent Number: 4,695,108

[45] Date of Patent: Sep. 22, 1987

[54] CONNECTOR FOR FLEXIBLE PRINTED CIRCUIT BOARD

[75] Inventor: Norio Ichitsubo, Yao, Japan

[73] Assignee: Hosiden Electronics Co., Ltd., Japan

[21] Appl. No.: 892,988

[22] Filed: Aug. 4, 1986

[51] Int. Cl.[4] ..... H01R 9/09

[52] U.S. Cl. ..... 439/59; 439/327; 439/77; 439/499

[58] Field of Search ..... 339/17 F, 75 MP, 176 MF

[56] References Cited

U.S. PATENT DOCUMENTS

| | | | |
|---|---|---|---|
| 4,188,086 | 2/1980 | Inouye et al. | 339/176 MF |
| 4,252,393 | 2/1981 | Johnson | 339/17 F |
| 4,480,886 | 11/1984 | Bergamin | 339/176 MF |
| 4,519,133 | 5/1985 | Pansanel | 339/176 MF |
| 4,526,436 | 7/1985 | Aso | 339/176 MF |
| 4,580,867 | 4/1986 | Wright et al. | 339/75 MP |
| 4,629,271 | 12/1986 | Awano | 339/176 MF |

*Primary Examiner*—John McQuade

*Attorney, Agent, or Firm*—Jones, Tullar & Cooper

[57] ABSTRACT

A connector for flexible substrates which can prevent the flexible substrate exactly from being pulled against ordinary pull-out force and allows the flexible substrate to be pulled out without being broken even when abnormally strong pull-out force beyond the assumed range is applied, and comprising a flexible substrate having an expanded section on its ends, a connector body having a cavity opened upward and the movable contact points of a number of terminals arranged side by side in a row in the cavity, and a housing mounted onto the connector body so as to close opening of the cavity and to hold the end of the flexible substrate inserted through the window of the top wall between a tongue and the movable contact point of the terminals, in which the window of the housing is formed of a wide opening to insert the expanded section of the flexible substrate, and a narrow opening communicated with the wide opening into which non-expanded section following the expanded section of the flexible substrate is fitted when the connector body is capped so that the non-expanded section is interlocked with the housing under the window when fitted into the narrow opening.

6 Claims, 6 Drawing Figures

CONNECTOR FOR FLEXIBLE PRINTED CIRCUIT BOARD

BACKGROUND OF THE INVENTION

1. Field of the Invention

The present invention relates to an improved connector for flexible printed circuits (FPC) assembled, for example, into a small-size word processor.

2. Prior Art

For small sized word processors, subsidiary circuit boards of a flexible nature are used to connect a printer head to a main substrate. For such a connection, as shown in FIG. 6, it has been conventional practice to cap a connector body 2 having a lot of terminals 1 arranged side by side in a row with a housing 3, to hold an end of a flexible substrate 7 passed through the above mentioned housing 3 between a movable contact point 5 of the terminal positioned in a cavity 4 of the connector body and a side tongue 6 of the housing thrusting into the above mentioned cavity, and to connect a lead 8 of the terminal 1 to a female connector, for example, at the side of the printer head. In other words, the end of the flexible substrate is fixed to the connector being held between the movable contact point 5 and the tongue 6.

While the printer head moves in a longitudinal or vertical direction for printing, tension is applied to the flexible substrate 7, which functions to pull the flexible substrate 7 from the connector. Accordingly, there is no problem if the connector has a large number of terminals (number of pins) and the flexible substrate is held firmly thereby. On the other hand, if the number of terminals is less and the holding power is low, the flexible substrate is pulled out easily leading to trouble. To avoid the trouble, it has been contrived, for example, to catch the end of the flexible substrate by a notch provided on the terminal. By this method, however, the flexible substrate is torn off and broken should an excessive tensile force beyond the range of ordinary assumption be applied for to any reason.

When such an excessive tensile force is applied, it is rather preferable that the flexible substrate is pulled out without being broken.

SUMMARY OF THE INVENTION

In view of the foregoing, it is a primary object of the present invention to provide a connector for flexible substrates which can make up for a low holding power of the movable contact point and the tongue against a pulling force beyond an allowable range of use to exactly prevent pulling out, and allows the substrate to be pulled out without being broken when a pulling force beyond the range is applied.

This object is attained by a connector comprising a flexible substrate having an expanded section formed on both ends thereof, a connector body having a cavity opened upward with movable contact points of a number of terminals positioned side by side in a row in the cavity, and a housing to cap the connector body so as to close an opening of the cavity and to hold an end of the flexible substrate, passed through a window on a top of the housing, between the torque shaped part and the movable contact points of the terminals, and wherein, the window of the housing is formed of a wide opening through which the expanded section of the flexible substrate is inserted, and a narrow opening, communicated with the wide opening into which the non-expanded section of the flexible substrate adjacent the expanded section is inserted when the connector body is capped, so that the expanded section is locked to the housing under the window as the non-expanded section is inserted into the narrow opening.

DETAILED DESCRIPTION OF THE PREFERRED EMBODIMENT

Figure 1:
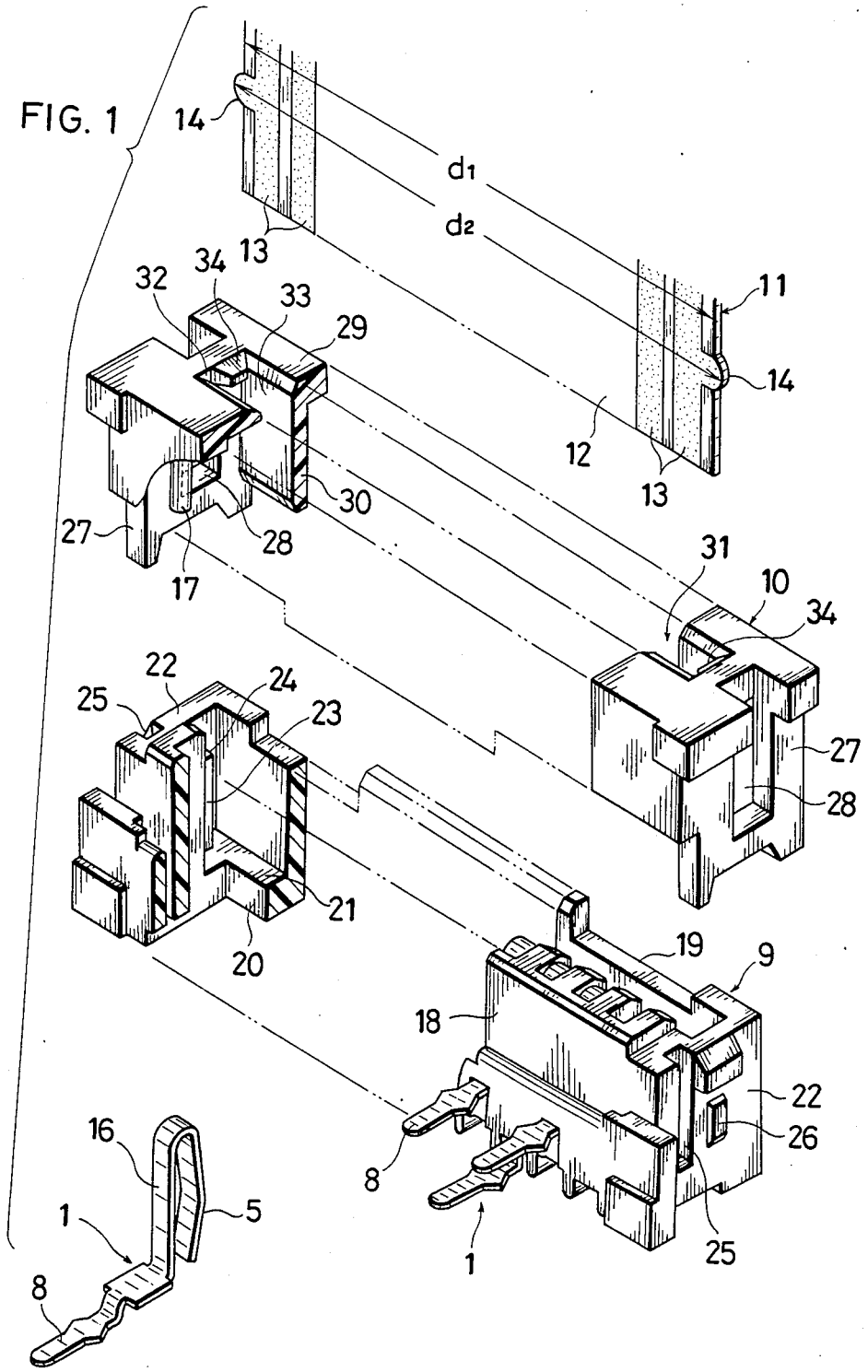
FIG. 1 is an exploded sectional and perspective view of an embodiment of the present invention.
Figure 2:
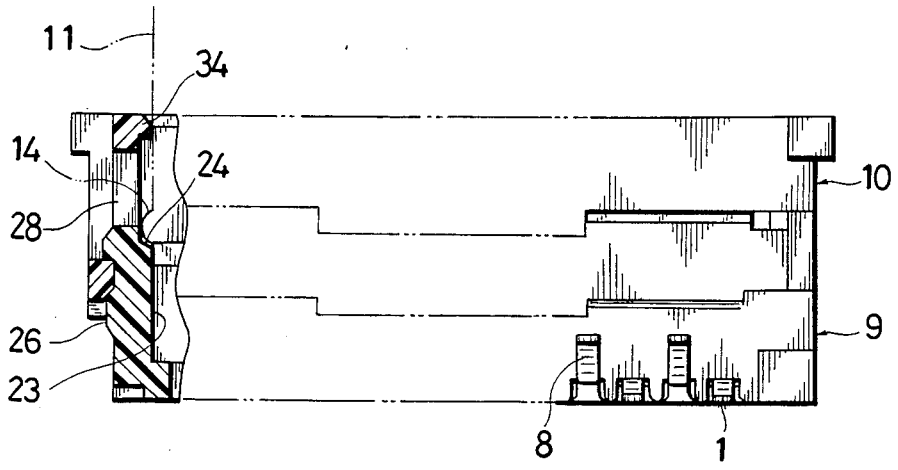
FIG. 2 is a partially cutaway front view of a connector body of the same embodiment in the middle of a capping motion with a housing.

In the embodiment shown in FIG. 1 to FIG. 5, a connector for flexible substrates comprises a connector body 9, a number of terminals 1 mounted onto the connector body, a housing 10 for capping the connector body 9, and a flexible substrate 11.

The flexible substrate 11 is made of a flexible resin base 12 with copper foil patterns 13 printed on the surface, circular legs 14, 14 formed solidly on both side edges of ends of the substrate 11 to be held at a certain distance from the bottom of the substrate to make a section $d_2$ wider than a substrate width $d_1$. The lugs 14 are also provided with the copper foil pattern 13 printed on their surface to reinforce the strength of the lugs. The copper foil pattern on the lugs 14, however, may be either omitted or shaped triangular or square.

Figure 3:
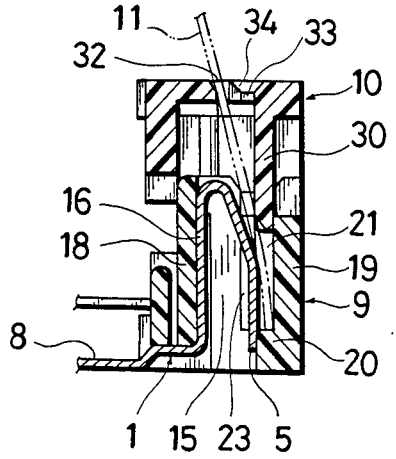
FIG. 3 is a longitudinal sectional view of FIG. 2.

The connector body 9 is a rectangular mold of synthetic resin having a space or a cavity 15 opened at the top and the bottom, into which an upright part 16 and a movable contact point 5 of terminals 1 are disposed by press fit. The terminals 1 are locked to the connector body 9 by a known method. That is to say, the terminals 1 are made of a thin copper plate punched out and bent, and one end thereof is used as a substantially horizontal lead 8, while the other end is bent to a substantially inverted D-shape and a free hanging section is used as the movable contact point 5. As shown in FIG. 3, the terminals 1 are mounted in a manner such that the upright section 16 comes in contact with a front wall 18 of the connector body 9 opposed to a rear wall 19 across the cavity 15, while the movable contact point 5 is in contact with the rear wall 19, and the lead 8 is projected outwardly from the connector body 9 passing through under the bottom of the front wall 18. The bottom of the rear wall 19 is formed into a projection 20 toward the front wall 18, and the end of the movable contact point 5 is put in contact with the end face of the projection 20 so that a narrow gap 21 is made between the rear wall 19 and the movable contact point 5. A number of terminals 1 are mounted on the connector body 9 side by side in a row. The direction of the leads 8 is not limited to the horizontal but may be downward.

As shown in FIG. 1 to FIG. 4, walls 22, 22 at the right and left of the connector body 9 facing each other across the cavity 15 are provided respectively with long ribs 23 solidly projecting from the body with a width of the above gap 21, and the upper end 24 of each rib 23 is tapered downward. A spacing between the ribs 23, 23 at the right and left sides is equal to a substrate width $d_1$ of the flexible substrate 11, while a spacing between the other sections of the right and left side walls 22, 22 is set equal to a width $d_2$ of the expanded section between the lugs 14, 14 of the flexible substrate 11. In addition, a section of the flexible substrate 11 to be held comes between the ribs 23, 23 as shown in FIG. 3.

A guide groove 25 and a locking projection 26 are provided at different positions on the outer face of the right and left side walls 22, 22 of the connector body 9.

The housing 10 is a long mold made of synthetic resin, and the inner face of the right and left side walls 27, 27 is provided with a projection strip 17 corresponding to the guide groove 25 on the connector body 9, and also with a lock hole 28 corresponding to the locking projection 26. A tongue 30 with its thickness equal to the width of the above mentioned gap 21 comes down from a top wall 29 corresponding to the gap 21. The top wall 29 has an opening 31 through which the flexible substrate 11 is passed, and the opening 31 is formed of a wider section 32 of the width $d_2$ to allow the lug 14 of the flexible substrate 11, i.e. the expanded section of the substrate to pass through, and a narrower section 33 of the width $d_1$ into which the non-expanded section of the substrate following the lug 14 is fitted. The narrower section 33 comes right above the ribs 23, 23 when the connector body 9 is capped with the housing, and is formed between the inner ends of the locking projections 34, 34 provided at both inner ends, facing each other, of the opening 31.

Figure 5:
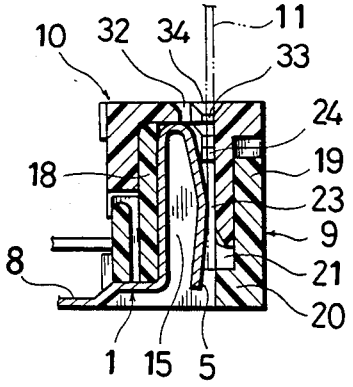
FIG. 5 is a longitudinal sectional side view of FIG. 4.
Figure 6:
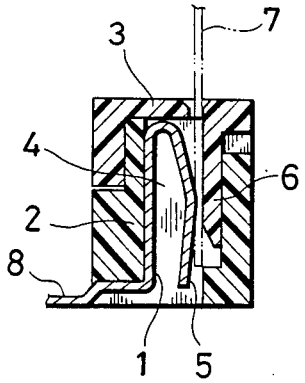
FIG. 6 PRIOR ART
FIG. 6 is a sectional view of a conventional connector for flexible substrates.

Accordingly, prior to capping the connector body 9 having a group of terminals with the housing 10, as shown in FIG. 3, an end of the flexible substrate 11 is pushed diagonally into the gap 21 of the connector body 9 through the wider section 32 of the opening 31, then the lug 14 is also passed through the wider opening 32 to be taken into the housing 10, and the housing 10 is pushed down and fitted into the connector body 9. Thus the tongue 30 goes into the gap 21, and the end of the flexible substrate 11 is pulled into and caught between the movable contact point 5 and the tongue 30. When pulled in and caught in this manner, the end of the flexible substrate 11 housed in the cavity 15 tends to by positioned straight in the vertical direction and extends upright from the diagonal position as shown in FIG. 5. The substrate extends into the narrower section 33, then the lug 14 extends under the bottom of the locking projection 34 to be locked. This motion is intensified further by the drawing force (tension) applied to the flexible substrate 11 when the tongue 30 extends into the gap 21. Accordingly, even when a pull-out force is applied to the flexible substrate 11, pulling-out is inhibited by the holding force of the movable contact 5 and the tongue 30 and by the interlocking force between the projection 31 and the lug 14. If the applied pull-out force is beyond the assumed range, the flexible substrate 11 is pulled out between the movable contact 5 and the tongue 30 while the lug 14 is deformed going over the locking projection 34 from the lower side upward, but the end of the flexible substrate 11 is not damaged at all.

Even when the flexible substrate 11 is slackened and not fitted into the narrower section 33, it is supposed to be automatically fitted thereinto once a tensile force is applied to the flexible substrate 11, and there is no problem about it.

Figure 4:
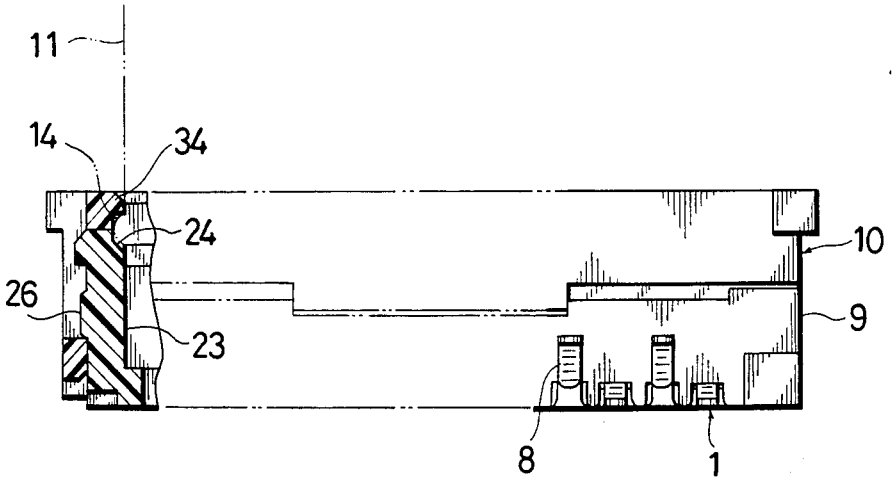
FIG. 4 is a partially cutaway front view of the same embodiment showing a capped condition.

When the flexible substrate 11 stands upright and fitted into the narrow section 33, it is also fitted between the ribs 23, 23 at the side of the connector body 9. As mentioned before, since the space between the ribs 23, 23 is equal to the width $d_1$ of the flexible substrate 11, both edges of the substrate are held closely from both sides by the ribs 23, 23 and loosening of the flexible substrate 11 is inhibited. The lug 14 going under tapered face 24 of the rib 23, and the lug 14 is caught between the locking projection 34 and the rib 23 from both upper and lower sides as shown in FIG. 4. Accordingly, loosening in the vertical direction is also inhibited.

Since the upper end of the rib 23 is made into a tapered face 24, the lug 14 of the flexible substrate 11 is not crushed by the locking projection 34 and the rib 23 when the connector body 9 is capped with the housing 10, and is held adequately, effectively preventing pulling out of the flexible substrate 11 and loosening in the vertical direction.

When the connector body 9 is capped with the housing 10, the projected strip 17 at the side of the housing 10 is fitted into the guide groove 25 at the connector body 9 side, and push-down of the housing 10 in the direction of the body 9 is adequately guided. Moreover, the locking projection 26 at the side of the connector body 9 goes into the lock hole 28 at the end of push-down, and the housing 10 is exactly locked.

What is claimed is:

1. A connector for flexible substrates comprising:

a flexible substrate having an expanded section formed on an end thereof, a connector body having a cavity opened upward with movable contact points of a number of terminals arranged side by side in a row in said cavity, and a housing mounted on said connector body so as to close an opening of said cavity and to hold an end of said flexible substrate inserted through a window on a top wall between a tongue and the movable contact points of said terminals, and in which, the window of said housing is formed of a wide opening to insert the expanded section of the flexible substrate, and a narrow opening communicated with said wide opening into which a non-expanded section following the expanded section of the flexible substrate is fitted when the connector body is capped so that the non-expanded section is interlocked with the housing under the window when fitted into the narrow opening.

2. A connector for flexible substrates according to claim 1, in which the expanded section of the flexible substrate is composed of a synthetic resin base and a copper foil pattern.

3. A connector according to claim 2, in which the expanded section of the flexible substrate is projected in circular, triangular, or square shape toward the non-expanded section.

4. A connector for flexible substrates according to claim 3, in which the narrow opening of the housing is formed by locking projections to prevent pull-out being projected from inner ends of the opening facing to each other, and the expanded section of the flexible substrate is interlocked with the housing by locking the expanded section at the lower side of said projections to prevent pull-out.

5. A connector for flexible substrates according to claim 4, wherein the expanded section of the flexible substrate is held in vertical direction between the projections to prevent pull-out and ribs provided in the housing.

6. A connector for flexible substrates according to claim 5, in which the top end of the ribs is tapered downward.

* * * * *